United States Patent [19]

Raisin et al.

[11] 4,055,244

[45] Oct. 25, 1977

[54] APPARATUS FOR INTRODUCING FABRIC ARTICLE PARTS TO AN ASSEMBLING MACHINE

[75] Inventors: Jean-Pierre A. Raisin; André R. Bernardot, both of Troyes, France

[73] Assignee: Centre Technique Industriel dit Institut Textile de France, France

[21] Appl. No.: 725,275

[22] Filed: Sept. 21, 1976

[30] Foreign Application Priority Data

Oct. 3, 1975 France ..... 75.30399

[51] Int. Cl.[2] ..... B23Q 7/04

[52] U.S. Cl. ..... 198/345; 112/121.15; 271/1

[58] Field of Search ..... 198/339, 345, 486, 650, 198/678, 695, 836; 112/121.11, 121.12, 121.15, 121.29; 223/43, 112; 271/1, 85

[56] References Cited

U.S. PATENT DOCUMENTS

| | | | |
|---|---|---|---|
| 2,959,412 | 11/1960 | Sjostrom | 271/85 |
| 2,989,934 | 6/1961 | Zeitlin | 198/345 |
| 3,337,212 | 8/1967 | Barker et al. | 271/1 |
| 3,534,954 | 10/1970 | Lynch, Jr. | 112/121.15 |
| 3,537,702 | 11/1970 | Kosrow et al. | 271/1 |
| 3,713,408 | 1/1973 | Deeks et al. | 112/121.15 |
| 3,722,437 | 3/1973 | Winberg et al. | 112/121.12 |
| 3,761,073 | 9/1973 | Brain | 112/121.15 |
| 3,769,924 | 11/1973 | Rogers et al. | 112/121.12 |
| 3,891,204 | 6/1975 | Mager | 271/85 |
| 3,970,016 | 7/1976 | Yanikoski | 112/121.12 |

FOREIGN PATENT DOCUMENTS

| | | | |
|---|---|---|---|
| 2,247,101 | 5/1975 | France | 112/121.12 |

*Primary Examiner*—Evon C. Blunk
*Assistant Examiner*—Richard K. Thomson
*Attorney, Agent, or Firm*—Weingarten, Maxham & Schurgin

[57] ABSTRACT

Apparatus for introducing fabric article parts to an assembling machine which comprises a first slide assembly incorporating a device for entraining the parts along the slide assembly and thence into the machine. The fabric article parts are initially suspended from a second slide assembly and a caliper which are movable along separate, but substantially parallel, paths leading to the intake of the first slide assembly.

8 Claims, 6 Drawing Figures

APPARATUS FOR INTRODUCING FABRIC ARTICLE PARTS TO AN ASSEMBLING MACHINE

BACKGROUND OF THE INVENTION a. Field Of The Invention

The invention relates to an installation for the transfer of article parts to an automatic assembling machine.

b. Description Of The Prior Art

Automatic machines for assembling articles are known, in particular for knitted articles, comprising an intake slide assembly, intended to receive articles to be assembled provided with retaining members along the sides of their selvedges, and means for moving these articles along the slide assembly. A machine of this type is for example described in French Patent Application No. 73.39606 filed Nov. 7, 1973.

In such a machine, the article parts are fed by a person who guides the articles by hand at the entry to the slide assembly during the whole of the duration of their introduction. This need for manual guidance of the articles requires the active participation by an operator during a relatively long period and limits the efficiency of the assembling machine.

One object of the present invention is to provide an installation enabling the avoidance of manual guidance of the articles throughout their introduction into the slide assembly andd to effect this introduction more readily in order to improve the efficiency of the machine.

SUMMARY OF THE INVENTION

According to the present invention there is provided in an installation for transferring article parts to an automatic assembling machine. The installation includes suspension means movable between a rear position and an advanced position along a first guide path and having first holding means for supporting the article parts between their front and rear ends, a guide carriage movable between a rear and forward position along a second guide path substantially parallel to the first path, and second holding means for engaging the rear ends of the article parts. Also included are control circuit means, first actuating means connected to the control circuit means for opening the first holding means when the suspension means and the guide carriage are in their respective forward position, and second actuating means connected to the control circuit means for opening the second holding means when the suspension means and the guide carriage are in their respective forward positions. An introduction slide assembly receives article parts to be assembled, each article part being provided with retaining members along the respective edges, the slide assembly having means for entraining the article parts therealong. The suspension means and the said carriage are movable along their respective guide paths to their forward positions for which the holding means are located at the intake to the slide assembly under the action of the said entrainment means at the time of the introduction to the slide assembly of article parts held by the holding means.

Thus, the manual operations are reduced to the suspension of an article part, for example substantially at its center, on the suspension device, the introduction of the front end of the article parts to the intake to the slide assembly, and the introduction of the rear assembly of the article into the guide device. Once the front end of the article is introduced into the slide assembly, this article is entrained along the slide assembly while being suspended and guided above the slide assembly. Because of this, the prson positioned in front of the installation in accordance with the invention has hands free for preparing the following articles to be introduced while an article is being automatically transferred to the assembly machine.

DESCRIPTION OF THE PREFERRED EMBODIMENT

Figure 1:
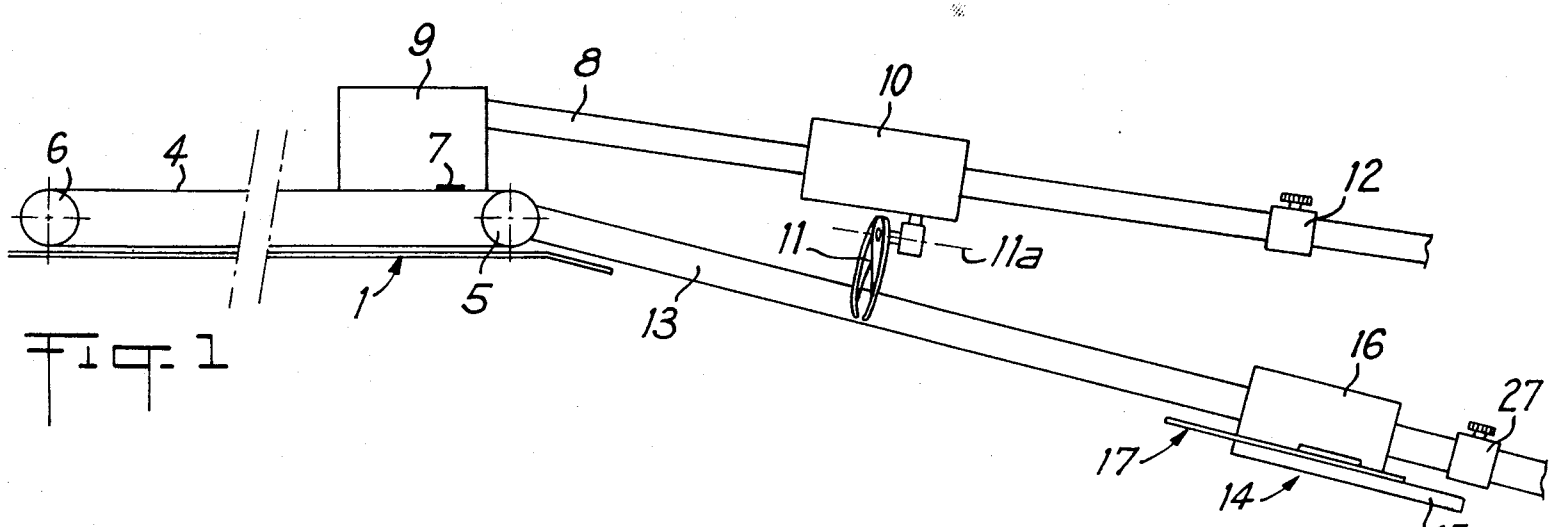
FIG. 1 is a diagrammatic elevation of an installation in accordance with the invention.
Figure 2:
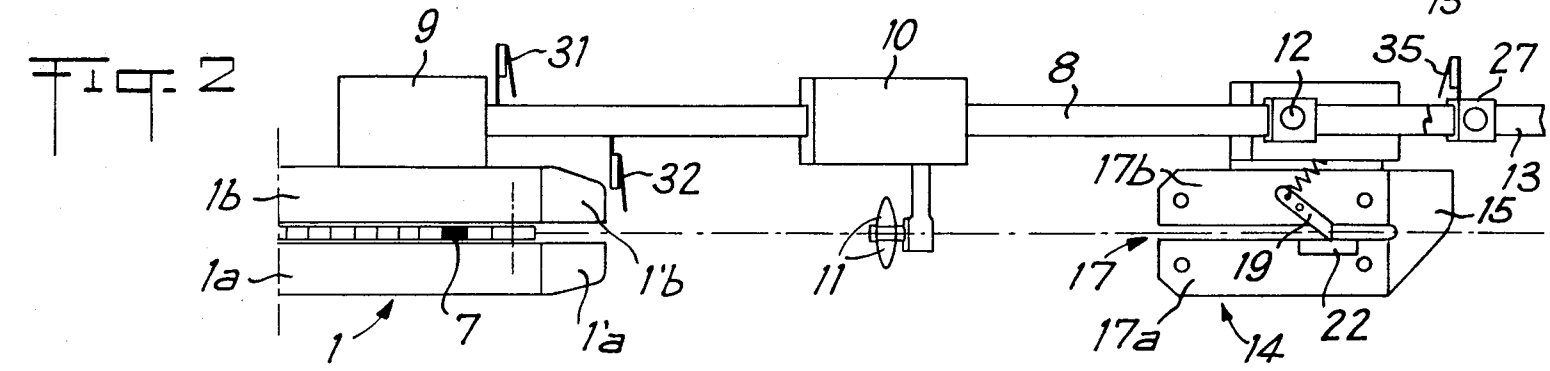
FIG. 2 is a diagrammatic view in plan of the installation of FIG. 1.
Figure 5:
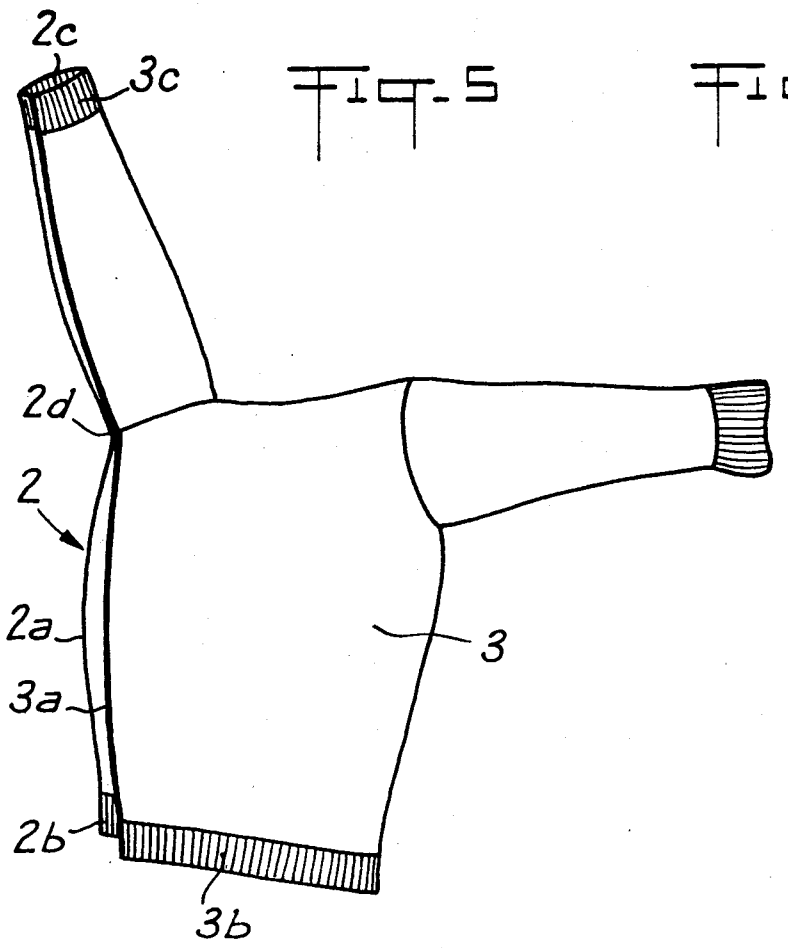
FIG. 5 is a view of an article suitable for transfer by the installation.

Referring to FIGS. 1 and 2, an article introduction slide assembly 1 is formed by two co-planar plates 1*a* and 1*b* spaced apart a controllable distance, and intended to receive knit fabric parts 2 and 3 (FIG. 5) constituting the front and the back of a pullover to be assembled to form a finished article. These knit fabric parts 2 and 3 are provided at their selvedges 2*a*, 3*a* with retaining members facilitating their suspension in the slide assembly 1.

An endless belt 4, mounted above the slide assembly 1 on rollers 5, 6, carries at least one shoe 7 arranged to contact the selvedges of the articles so as to displace the articles, suspended in the slide assembly 1, towards an automatic assembling machine for seaming the selvedges, for example, the machine described in French Patent Application No. 73.39606 referred to hereinbefore. The belt 4 may be replaced by a chain and sprocket wheels.

The installation further includes a first guide rail 8 extending parallel to the vertical plane of symmetry of the slide assembly 1. The rail 8 is fixed at 9 to the structure of the assembling machine (not otherwise shown) and is inclined to the horizontal upwardly in the direction toward the slide assembly.

A slide member 10 slides on the rail 8 and carries a pair of calipers 11 pivoted about an axis 11*a* extending parallel to the rail 8. The verticle plane of symmetry of the calipers 11 is substantially in alignment with that of the slide assembly 1. The lower ends of the calipers 11 lie a few millimeters above the end of the entry to the slide assembly 1 when the slide member 10 lies adjacent this end.

The movement of the slide member 10 is limited downwardly by an abutment 12 adjustably fixedon the lower part of the rail 8.

Figure 4:
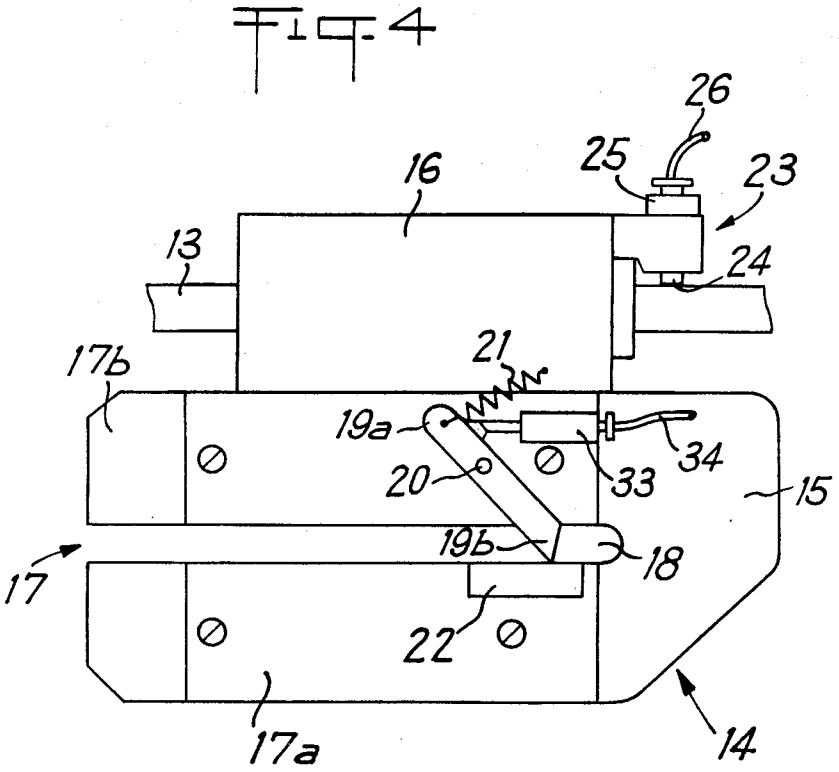
FIG. 4 is a view, to an enlarged scale, of a guide device of the installation of FIGS. 1 and 2.

A second guide rail 13 secured to the structure of the assembling machine extends substantially parallel to the vertical plane of symmetry of the slide assembly 1, and lies beneath the rail 8. The rail 13 is inclined to the horizontal upwardly in the direction of the slide assembly 1. A carriage 14 mounted on the rail 13 comprises a support 15 rigid with a slide member 16 slidable on the rail 13. The carriage 14 carries a slide assembly 17 constituted by two co-planar plate parts 17*a*, 17*b* screwed to the support 15. A slot 18, (see FIG. 4) formed in the support 15 corresponds to a similar slot of the slide assembly 17. The spacing between the parts of the plate 17*a,* 17*b* is variable in order to adapt to the thickness of the articles to be transferred to the assembling machine, similarly to the spacing between the plate 1*a,* 1*b* constituting the slide assembly 1.

The position of the plate parts 17*a,* 17*b* on the support 15 and the inclination of the rail are such that the ends of the parts of the plate can abut with the inclined end parts 1'*a* and 1'*b* of the plates 1*a* and 1*b.* In this position, the slide assembly 1 and the slide assembly 17 form extensions of one another and their planes of symmetry coincide.

A retaining finger 19 is pivotally mounted about a pin 20 carried by the support 15. At one end 19*a,* the finger 19 is controlled by a return spring 21, supported on the slide member 16. Under the action of this spring, the other end 19*b* of the finger 19 is applied against an abutment 22 rigid with the support 15. The pin 20 and the abutment 22 are situated on opposite sides of the slot of the slide assembly 17, the retaining finger 19 serving to close the slot in the slide assembly when it engages against the abutment 22.

The carriage 14 comprises a brake 23 constituted for example by a shoe 24 rigid with a piston slidable in a cylinder 25 carried by the slide member 16. The brake 23 is pneumatically actuated, the cylinder 25 being connected by a pipe 26 to a source of pressure fluid (not shown). The pressure exerted by the shoe 24 on the rail 13 is adjustable so as to control the intensity of the braking action on the carriage 14.

An abutment 27, adjustably secured to the lower part of the rail 13 limits downwardly the passage of the carriage 14. The lower ends of the calipers 11 follow a trajectory parallel to the rail 8 and pass a few millimeters above the entry to the slide assembly 1 while the part of the carriage 14, when moving below the calipers 11 follows a trajectory parallel to the rail 13 and passes by the entry end of the slide assembly 1. In order to avoid all contact between the calipers 11 and the carriage 14, the angle of inclination with respect to the horizontal of the rail 13 is selected to be at least equal to that of the rail 8.

The operation of the installation will be described hereinafter in use for transfer of article parts such as 2 and 3 (FIG. 5) intended to form a pull-over, the assembling machine effecting the sewing together of the selvedges 2*a* and 3*a* of the article parts extending from the belt parts 2*b,* 3*b* to the cuff parts 2*c,* 3*c.* One or more retaining points are previously provided on the selvedges 2*a,* 3*a* particularly at the level of the under-arm joint 2*d.*

Figure 3:
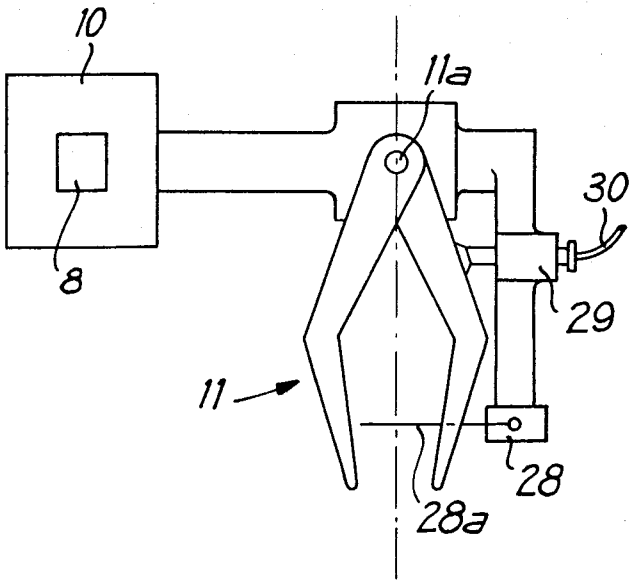
FIG. 3 is a view, to an enlarged scale, of a suspension device of the installation of FIGS. 1 and 2.

The article parts 2 and 3 are initially suspended manually by an operator by introduction of the under-arm joint 2*d* or of a portion of the selvedges 2*a,* 3*a* adjacent to this under-arm joint, between the calipers 11, the slide member 10 resting against the abutment 12. These calipers have been opened previously and the introduction of the under-arm joint 2*d* causes the operation of a feeler 28 (FIG. 3) comprising a rod 28*a* which extends transversly in the space between the individual ends of the calipers 11 or a zone adjacent this space. Displacement of the rod 28*a* controls the closure of the calipers 11 by a pneumatic cylinder 29 connected to a source of pressure fluid through a pipe 30.

After under-arm joint 2*d* has been gripped by the calipers 11, the article parts 2 and 3 are suspended and the operator then proceeds manually to introduce the ends of the selvedges 2*a* and 3*a* at the level of the belt 2*b,* 3*b,* into the slide assembly 1, the retaining members formed along these selvedges resting on the upper faces of the plates 1*a,* 1*b.*

As soon as the shoe 7 is applied to the front ends of the article parts 2, 3 engaged in the slide assembly 1, the parts 2 and 3 are moved in a translatory sense in the slide assembly and themselves drive the calipers 11 and their slide member 10 along the guide rail 8.

The operator then proceeds with the introduction of the ends of the selvedges 2*a* and 3*a,* at the level of the end edges of the sleeve 2*c,* 3*c,* into the slide assembly 17, the slide member 16 then resting against the abutment 27. This introduction of the rear ends of the article parts 2, 3 into the slide assembly 17 is effected until the moving knit fabric causes the retaining finger 19 to pivot which, biased by the spring 21, wedges the knitwear against the abutment 22 and secures it in the slide assembly 17.

Approximately during the introduction of the rear end of the article parts 2, 3, into slide assembly 17, the calipers 11 arrive at the level of the intake end of the slide assembly 1, holding the under-arm joint 2*d* a few millimeters above this intake end. The slide member 10 then comes into contact with a feeler 31, secured to the rail 8. This feeler, when actuated, controls the opening of the calipers 11 by interrupting the fluid supply to the pneumatic cylinder 29 and the slide member 10 carrying the calipers 11 returns under gravity to the abutment 12.

The introduction of the sleeve, beyond the under-arm joint 2*d* is effected continuously by the traction exerted by the belt 4. The controllable brake 23 exerts a slight resistance to the displacement of the carriage 14 along the rail 13, in order to impart a light tension to the knitwear to allow its correct introduction into the slide assembly 1.

When the parts of the plate 17*a,* 17*b* come into abutment with the intake end of the slide assembly 1, the carriage 14 actuates a feeler 32 disposed laterally with respect to the intake end. The feeler controls, through an air cylinder 33 carried by the carriage 14 and connected by a pipe 34 to a source of fluid under pressure, the pivoting action of the retaining finger 19 in opposition to the force exerted by the spring 21. The rear ends of the article parts 2 and 3 being freed, the edge 2*c,* 3*c* of the sleeve passes directly from the slide assembly 17 to the slide assembly 1.

The action of the brake 23 is interrupted by cutting off its supply of fluid under pressure, this cut-off being controlled by the feeler 32 aftera predetermined delay. The carriage 14 again descends under gravity and abuts against the abutment 27.

The return of the carriage 14 to the abutment 27 causes the actuation by the slide member 16 of a feeler 35 mounted on the abutment 27, which feeler controls the re-establishment of braking action by the brake 23 and the return of the retaining finger 19 against the abutment 22.

During the introduction of the sleeve of the article part to the slide assembly 1, the operator can prepare the positioning of the following articles and the suspension thereof in the calipers 11.

The cylinders 29, 33 and the pneumatic brake 23 are controlled by the feelers 28, 31 32 and 35 which act through the intermediary of control circuits on electrically-operated valves 36, 37, 38 (FIG. 6) incorporated respectively in the pipes 30, 34 and 26.

Figure 6:
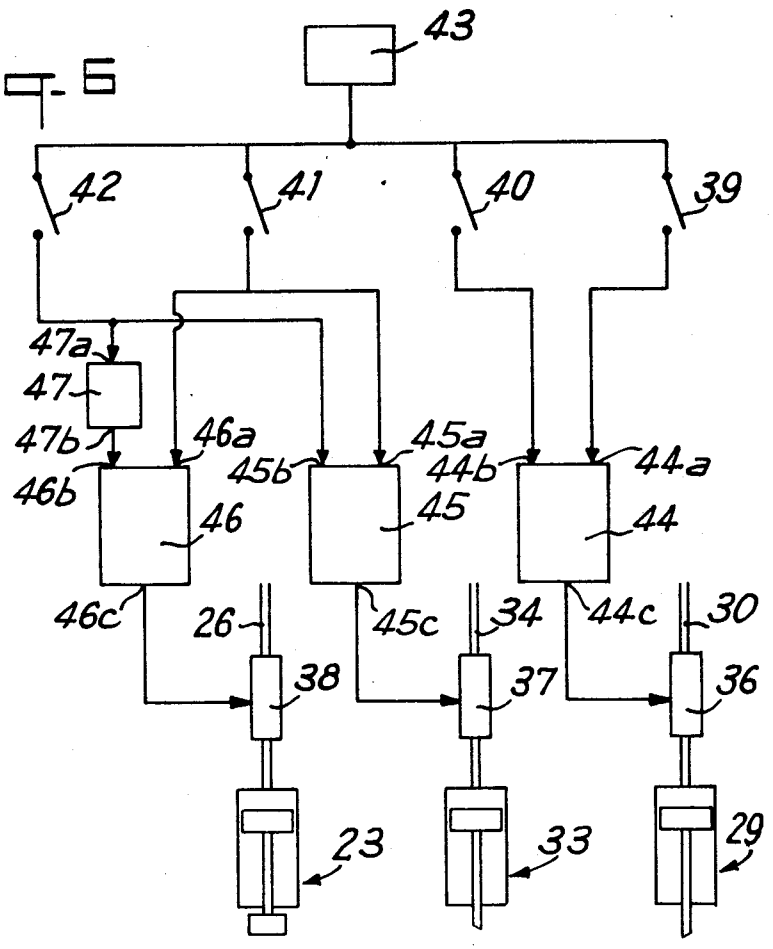
FIG. 6 is a diagram of control circuits of the installation of FIGS. 1 and 2.

An embodiment of the control circuits is illustrated in FIG. 6.

The feelers 28, 31, 32, 35 when they are actuated, cause the closure of switches 39, 40, 41, 42 each having one contact connected to a potential source 43.

The second contacts of the switches 39, 40 are connected respectively to the first input 44*a* and the second input 44*b* of a bistable 44, the output 44*c* of which is connected to the driving circuit of the electrically-operated valve 36. When the bistable 44 receives a signal at its input 44*a* following the closure of the switch 39, it emits an output signal causing opening of the electrically-operated valve 36 and the closdure of the calipers 11 by the cylinder 29, which output signal is interrupted on the generation of a signal at its input 44*b* following the closure of the switch 40.

The second contacts of the switches 41, 42 are connected, on the one hand, respectively to the first input 45*a* and to the second input 45*b* of a bistable 45 and, on the other hand, respectively to the first input 46*a* of a bistable 46 and to the input 47*a* of a delay circuit 47.

The output 45*c* of the bistable 45 is connected to the driving circuit of the electrically-operated valve 37 so as to control the opening of this electrically-operated valve and the pivoting of the finger 19 between the instants corresponding to the closures of the switches 41 and 42.

The output 47*b* of the delay circuit 47 is connected to the second input 46*b* of the bistable 46 the output 46*c* of which is connected to the driving circuit of the electrically-operated valve 38 so as to control the interruption of the supply to the brake 23 between the instant of closure of the switch 42, delayed by the circuit 47 and the instant of the closure of the switch 41. The circuit 47 introduces a delay of which the duration is selected to be in excess of that of the transfer to the slide assembly 1 of the end parts of the article parts 2 and 3, introduced into the member of the slide assembly 17.

In an unillustrated modification the slide member 10 supporting the calipers 11 has a pneumatic braking device with a structure and operation similar to those of the brake forming part of the equipment of the carriage 14. Moreover, it is possible to replace such a braking device by additional masses secured to the slide member.

We claim:

1. In an installation for transferring article parts to an automatic assembling machine, suspension means movable between a rear position and an advanced position along a first guide path and comprising first holding means for supporting the article parts between their front and rear ends, a guide carriage movable between a rear and forward position along a second guide path substantially parallel to the first path, and second holding means for engaging the rear ends of the article parts, control circuit means, first actuating means connected to the control circuit means for opening the first holding means when the suspension means is in its forward position, second actuating means connected to the control circuit means for opening the second holding means when the guide carriage is in its forward position, an introduction slide assembly for receiving article parts to be assembled, each article part being provided with retaining members along the respective edges, and means for entraining the article parts along the slide assembly, the said suspension means and the said carriage being movable along their respective guide paths to their forward positions for which the holding means are located at the intake to the slide assembly, under the action of said entrainment means at the time of the introduction to the slide assembly of article parts held by said holding means.

2. An installation according to claim 1, wherein the suspension means comprises a caliper, a first guide rail extending substantially parallel to the vertical plane of symmetry of the slide assembly and inclined to the horizontal upwardly towards the slide assembly, and a support carrying the caliper and slidably mounted on the first guide rail, the lower ends of the calipers being arranged to lie immediately above the entry end of the slide assembly when the slide assembly is in its forward position on the first guide rail.

3. An installation according to claim 2 comprising an abutment mounted on an upper part of the first guide rail and carrying the said first actuating means, and a second abutment mounted on a lower part of the first guide rail and serving to limit the return movement of the suspension means after the first holding means has been opened.

4. An installation according to claim 2 wherein said caliper comprises control means operative to close the calipers on introduction of an article part thereto.

5. An installation according to claim 2 comprising a second guide rail extending substantially parallel to the vertical plane of symmetry of the slide assembly and inclined to the horizontal upwardly towards the slide assembly, the guide carriage being slidably mounted on the second guide rail, a second slide assembly arranged to form an extension of the first slide assembly when the carriage has moved along the second guide rail to a predetermined position, and a braking device mounted on the carriage and connected to the second actuating means whereby to cease the braking action and enable the return movement of the carriage after completion of the introduction of the article parts to the first slide assembly.

6. An installation according to claim 5, comprising a first abutment mounted on the upper part of the second guide rail and carrying the second actuating means, and a second abutment mounted on the lower part of the second guide rail and limiting the return movement of the carriage.

7. An installation according to claim 5, wherein the said second holding means comprises a retaining finger pivoted on the carriage and arranged to fix the rear ends of article parts on the said second slide assembly an actuating member arranged to pivot the finger and a resilient element arranged to bias the finger against the action of the actuating member.

8. A method of transferring fabric article parts to an assembling machine, each article part having a retaining member extending along the selvedge thereof, the machine having an input slide assembly with means for entraining the article parts along the slide assembly, the method comprising the steps of suspending each article to be transferred to the machine at its selvedge and substantially at its central part from a first holding means with a controllable opening and movable along a first guide path up to the intake of the slide assembly, introducing the front part of the selvedge zone of each article part to the intake of the slide assembly in order that this front part can be entrained by the entraining means, and introducing the rear part of the selvedge zone of each article part into a second holding means with a controlled opening and movable along a second guide path up to the intake of the slide assembly.

* * * * *